US005931093A

United States Patent [19]

Walther et al.

[11] Patent Number: 5,931,093

[45] Date of Patent: Aug. 3, 1999

[54] PNEUMATIC SHEET GUIDING DEVICE IN A PRINTING MACHINE

[75] Inventors: Thomas Walther, Freigericht; Anthimos Giapoulis, Munich; Edgar Dorsam, Obertshausen, all of Germany

[73] Assignee: MAN Roland Druckmaschinen AG, Germany

[21] Appl. No.: 09/008,392

[22] Filed: Jan. 16, 1998

[30] Foreign Application Priority Data

Jan. 16, 1997 [DD] German Dem. Rep. ..... 197 01 2302

[51] Int. Cl.[6] ..... B65H 29/24

[52] U.S. Cl. ..... 101/232; 271/265.02; 271/195; 198/195; 406/88; 406/12; 414/793.1

[58] Field of Search ..... 101/230, 231, 101/232; 406/88; 198/438, 495, 370.11; 137/115.04; 414/795.5

[56] References Cited

U.S. PATENT DOCUMENTS

| | | | |
|---|---|---|---|
| 3,592,329 | 7/1971 | Fleischauer | 198/438 |
| 4,572,071 | 2/1986 | Cappel et al. . | |
| 5,348,040 | 9/1994 | Shellhause | 137/115.04 |
| 5,423,255 | 6/1995 | Maass | 101/232 |
| 5,476,041 | 12/1995 | Czotscher | 101/232 |
| 5,488,905 | 2/1996 | Secor | 101/232 |
| 5,497,987 | 3/1996 | Henn et al. | 101/232 |
| 5,611,276 | 3/1997 | Haupenthal | 101/232 |
| 5,634,636 | 6/1997 | Jackson et al. | 271/225 |
| 5,816,155 | 10/1998 | Stephan | 101/232 |
| 5,839,722 | 11/1998 | Berlin et al. | 271/195 |

FOREIGN PATENT DOCUMENTS

| | | |
|---|---|---|
| 0 156 173 | 12/1989 | European Pat. Off. . |
| 28 46 643 | 12/1979 | Germany . |
| 43 08 276 A1 | 9/1994 | Germany . |
| 296 07 087 | 7/1996 | Germany . |

*Primary Examiner*—Eugene Eickholt
*Attorney, Agent, or Firm*—Leydig, Voit & Mayer, Ltd.

[57] ABSTRACT

A device for guiding a sheet as it is conveyed through a deliverer or between printing units of a sheet-fed printing machine is provided. The sheet guiding device includes a guide surface which has a plurality of openings therein and a housing which is arranged below the guide surface and which together with the guide surface defines a flow duct. The guiding device also includes a air system which is in fluid communication with the flow duct. At least one flexible hollow seal member is arranged in the flow duct and is adapted such that it can be selectively filled with a fluid medium which expands the seal member into a sealing position wherein it seals off a predetermined portion of the openings in the guide surface from the air system.

10 Claims, 3 Drawing Sheets

PNEUMATIC SHEET GUIDING DEVICE IN A PRINTING MACHINE

FIELD OF THE INVENTION

The invention generally relates to printing machines and, more particularly to a pneumatic sheet guiding device for a sheet-fed offset printing machine.

BACKGROUND OF THE INVENTION

Sheet guiding devices are provided at various locations within a printing machine including, for example, in the deliverer and in the transfer system between the printing units in order to guide the sheets of printed material as they are conveyed through the printing machine. One example of such a guiding device is disclosed in DE 28 46 643 Al. The sheet guiding device disclosed in this reference is arranged in the sheet deliverer of a printing machine and comprises sheet guiding brackets which are adjustably mounted across the width of the printing machine and pivotable suction boxes that are arranged between the sheet guiding brackets.

A sheet-guiding device which has guide surfaces having a plurality of openings therein is disclosed in EP 0 156 173 Bl. The guide surfaces have associated flow ducts which are in fluid communication with fans that are selectively operable to provide either a positive air flow or a negative or suction air flow through the openings in the guide surfaces.

Another sheet guiding device is disclosed in DE 43 08 276 Al. This particular sheet-guide device also has a plurality of openings through which air can be blown. One of the openings is formed by a front face integrated into the sheet guide surface as an impact surface and includes a flow duct which opens at an angle into the into the sheet guide surface.

One of the significant problems associated with the pneumatic sheet guiding systems used in these and other prior art designs is that they take very little account of the format of the printed material being processed in a particular print run. Specifically, when the printed material being processed has a format different from the maximum which can be handled by the printing machine, the operation of the pneumatic guide system can cause air flow disturbances which can lead to sheet flutter. Accordingly, these sheet guiding systems do not guide printed materials having different formats in a uniform manner. These air flow disturbances can result from effective air flow losses which occur as a result of processing printed material which has a format less than the maximum which can be processed by the printing machine. One method which can be used to compensate for these air flow disturbances is to increase the volume of air flow provided by the air system powering the pneumatic guide system. However, this results in an increased power consumption and, in turn, increased manufacturing costs.

OBJECTS AND SUMMARY OF THE INVENTION

Accordingly, in view of the foregoing, it is a general object of the present invention to overcome the aforementioned problems associated with prior art pneumatic sheet guiding systems relating to processing printed material having different formats.

A more specific object of the present invention is to provide a pneumatic sheet guiding device or system for a printing machine which guides sheets of printed material having different formats in a uniform manner.

A related object of the present invention is to provide a pneumatic sheet guiding device which can be readily adapted to handle printed material having different formats.

The present invention provides these and other advantages and overcomes the drawbacks of the prior art by providing a sheet-guiding device which is selectively adjustable for sheets having different formats. The sheet guiding device includes a guide surface which has a plurality of openings therein and a housing which is arranged below the guide surface and which together with the guide surface defines a flow duct. The guiding device also includes a air system which is in fluid communication with the flow duct.

At least one flexible hollow seal member is arranged in the flow duct and is adapted such that it can be selectively filled with a fluid medium which expands the seal member into a sealing position wherein it seals off a predetermined portion of the openings in the guide surface from the air system. Accordingly, through the use of the seal member a portion of the guide surface which is not needed for a particular sheet format can be sealed off from the flow of air from the air system as desired.

These and other features and advantages of the invention will be more readily apparent upon reading the following description of a preferred exemplary embodiment of the invention and upon reference to the accompanying drawings wherein:

While the invention will be described and disclosed in connection with a certain preferred embodiment and procedure, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
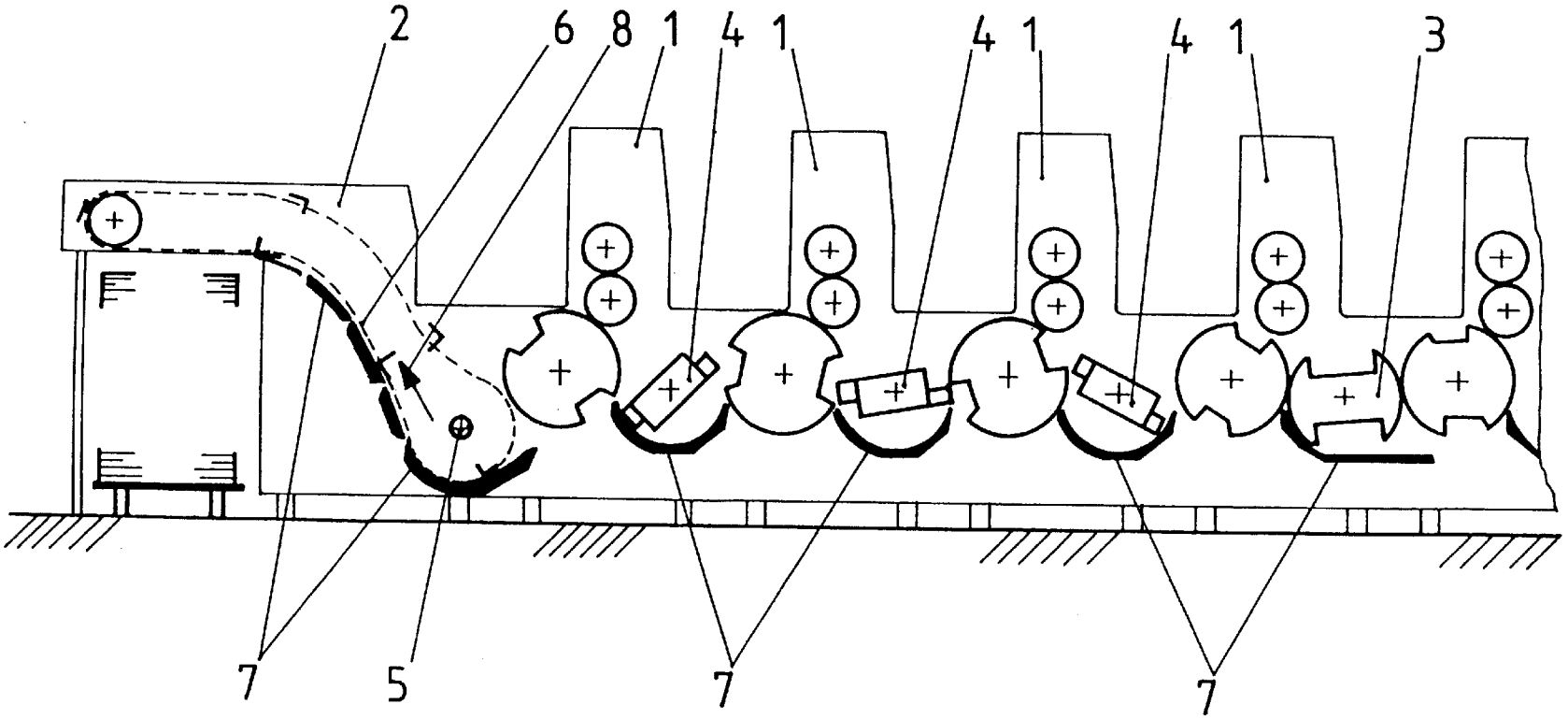
FIG. 1 is a schematic side view of an illustrative sheet-fed offset printing machine having sheet guiding devices constructed in accordance with the teachings of the present invention.

Referring now more particularly to FIG. 1 there is shown a schematic view of a multi-color sheet-fed offset printing machine which includes sheet guiding devices constructed in accordance with the present invention. As described in detail below, the sheet guiding devices can be selectively adjusted or adapted based on the format of the printed material being processed such that printed materials having different formats are guided in a substantially uniform manner. While the sheet guiding device of the present invention is described in connection with the deliverer and transfer systems of a multi-color offset printing machine, it will be readily appreciated that the present invention is equally applicable to other types of printing machines and other components of printing machines including, for example, suction bars, sheet brakes, and sheet smoothers.

As shown in FIG. 1, the illustrated printing machine includes a plurality of printing units 1 that are arranged in series. In order to transfer the sheets 15 (FIGS. 4 and 5) between the printing units 1, the printing machine includes a plurality of transfer drums 4 and turning drums 3 arranged between the printing units 1. In particular, the transfer drums 4 and the turning drums 3 define a transfer system which moves the sheets 15 in a conveying direction 8 as they are processed. In a known manner, a deliverer 2 is arranged downstream from the last printing unit 1. In order to transport the sheets, the deliverer 2 has a circulating chain system 16 which is driven by a chainwheel shaft 5 and is equipped with gripper systems 18.

Figure 4:
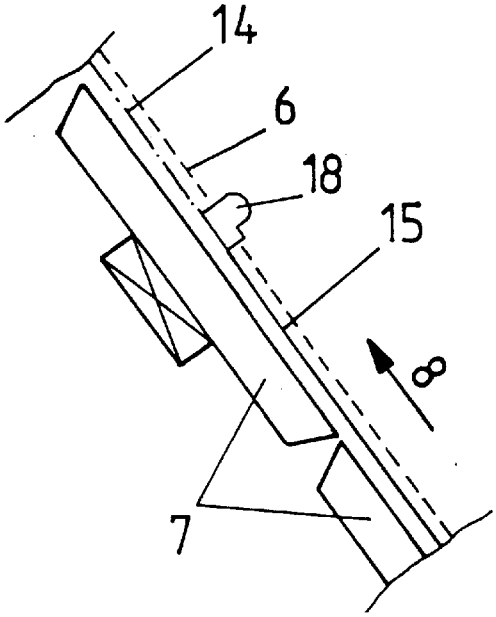
FIG. 4 is a schematic side view of the illustrative printing machine showing the arrangement of the sheet guiding devices in the deliverer.
Figure 5:
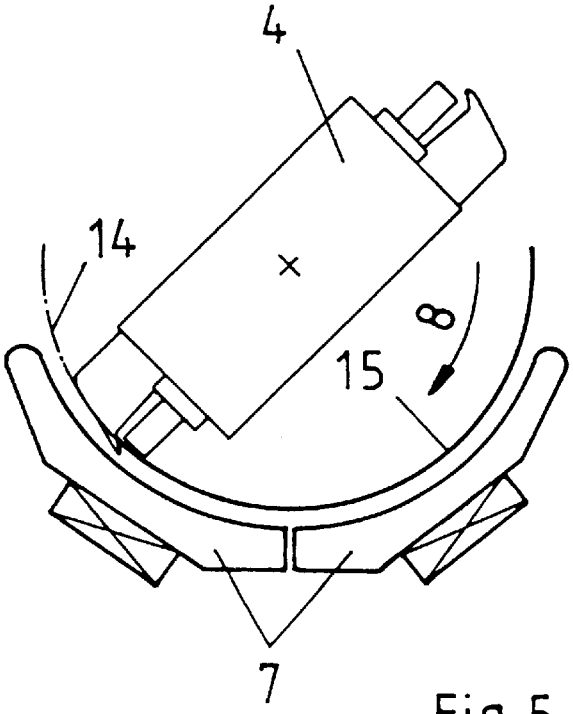
FIG. 5 is a schematic side view of the illustrative printing machine showing the arrangement of the sheet guiding devices in the sheet transfer system.

For the purpose of guiding the sheets as they are conveyed through the printing machine, the illustrated printing machine includes a plurality of sheet guiding devices 7. In particular, in the illustrated printing machine a plurality of sheet-guiding devices 7 are assigned to the sheet transfer system, including the transfer drums 4 and turning drum 3, and to the deliverer 2. The sheet guiding devices 7 preferably have a modular construction. Each sheet guiding device 7 has a guide surface 10, which is disposed substantially parallel to the sheet-conveying path 14. In the deliverer 2 (as shown in FIG. 1) and with the individual turning and transfer drums 3, 4 (as shown in FIGS. 4 and 5) the individual sheet guiding devices 7 are preferably arranged next to one another in order to form a sheet guide surface that is as uniform as possible.

Figure 2:
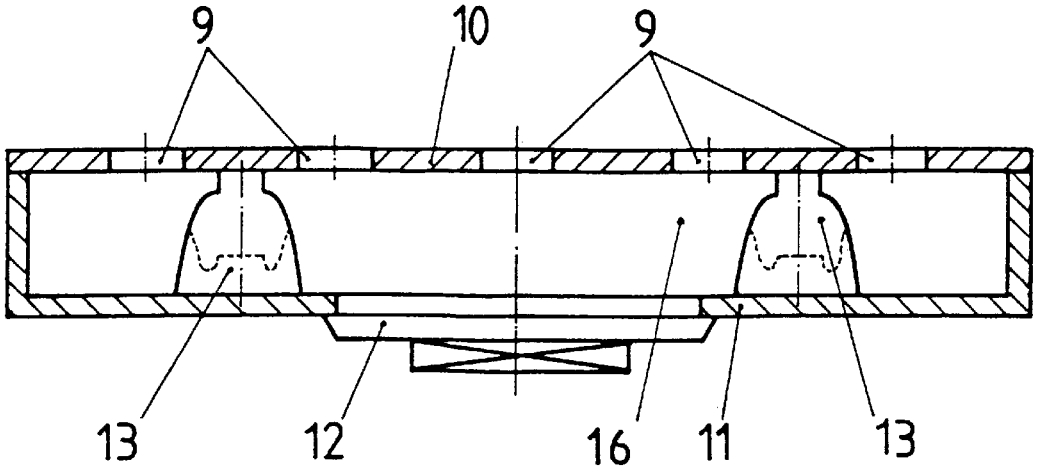
FIG. 2 is a cross-sectional view of the sheet guiding device of the illustrative printing machine.

In order to assist the guiding of the printed material, the guide device 7 is adapted to be pneumatically powered such that it can selectively provide a gaseous flow agent, e.g. air, in either a positive pressure (blowing) or negative pressure (suction) mode at the guide surface 10. To this end, a plurality of openings 9 through which air can flow are provided in the guide surface 10. In addition, a closed housing 11 is provided which along with the guide surface 10 defines a flow duct 16 as shown in FIG. 2. The air flow is generated by at least one pneumatic or air system 12, such as for example a fan, which is arranged on the housing 11 and is in fluid communication with the flow duct 16. In the positive pressure mode, the air system 12 provides a cushion of air at the guide surface 10 which supports and guides the sheets 15. In the negative pressure mode, the air system 12 operates to draw the sheets toward the guide surface 10 and thereby ensures positive contact between the sheets 15 and the guide surface.

Figure 3:
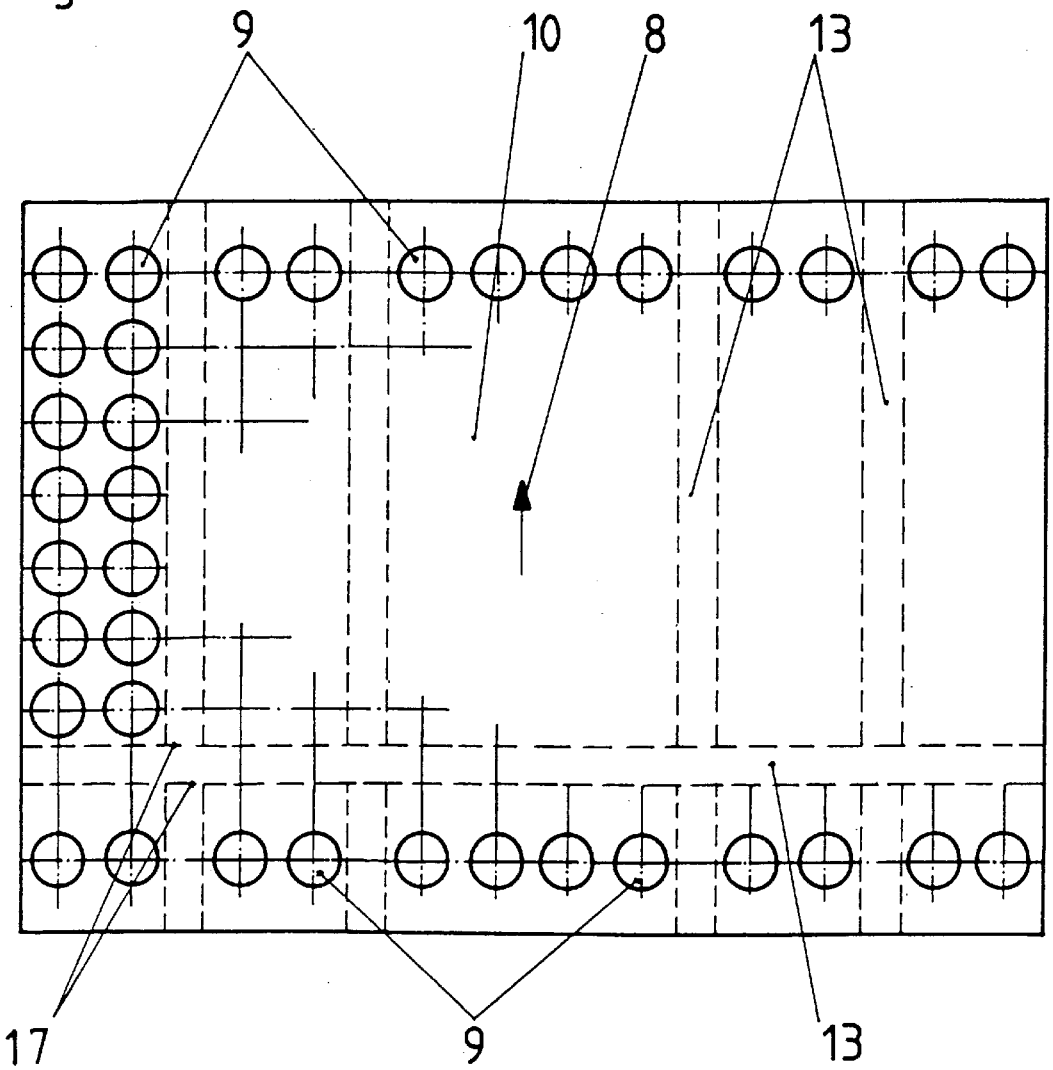
FIG. 3 is a plan view of the guide surface of the sheet guiding device of the illustrative printing machine.

In accordance with an important aspect of the present invention, the sheet guiding device is adapted such that it can be selectively adjusted based on the format of the sheets that are being processed. In particular, as best shown in FIG. 2, hollow flexible seal members 13 are arranged in the flow duct 16 which can be used to selectively seal off areas of the flow duct and, in turn, the openings 9 in the guide surface 10 from the flow of air. The seal members 13 are hollow and flexible so that they can be selectively loaded, filled or inflated with a fluid medium in order to move the seal members between a disengaged or open position and a sealed position. For example, the hollow seal members 13 may be filled with compressed air or, when dryers are used, possibly by a coolant. Preferably, the hollow seal members 13 should be provided with a different fluid source than the air system 13. The hollow seal members 13 are preferably arranged along the base of the housing 11 in the flow duct 16 as shown in FIG. 2 such that when the seal members are loaded they expand into a sealing position wherein they engage the lower side of the guide surface 10. As shown in FIG. 3, the seal members preferably extend between the side walls of the flow duct 16 such that selected areas of the flow duct 16 can be sealed off by inflating the hollow seals 13. In FIG. 2, the sealed position of the hollow seal members 13 is shown in solid lines and the disengaged or open position of the seals is shown in broken lines. Alternatively, the hollow seal members can be arranged such when they are filled or loaded they expand to directly engage the openings 9 in the guide surface 10. It will be appreciated that while the illustrated sheet guiding device has several seal members, only one seal member need be provided in the flow duct to practice the present invention.

Furthermore, the hollow seal members 13 can extend in a direction parallel to the conveying direction 8 of the sheets 15, and also perpendicular to the conveying direction 8. As shown in FIG. 3, the illustrated sheet guiding device 7 includes some seal members 13 which extend in a direction parallel to the conveying direction 8 and some which extend in a direction perpendicular to the conveying direction. As will be appreciated, the crossing hollow seal members 13 are adapted such that each seal member 13 can be loaded with the respective fluid medium and, in turn, moved into the sealed position independently of the other seal members 13. Where the seal members intersect or cross one another a butt-on butt mounting 17 is provided.

In accordance with a further aspect of the present invention, the hollow seal members 13 are adapted such that when the seals are disengaged or empty their relative positions in the flow duct can be selectively adjusted or moved. The movable mounting of the seal members enables the sheet guiding device 7 to be more easily adjusted for different format widths. In particular, for different sheet formats, the seal members 13 which extend in the conveying direction 8 in the flow duct 16 can be moved transversely to the conveying direction 8 in such a manner that the areas of the guide surface 10 which are not needed for that particular sheet format will be effectively sealed off from the air system 12 upon loading or filling of the seal members. In other words, the seal members 13 are moved into certain preselected positions and then filled or loaded with the fluid medium such that the effective guide surface 10, i.e. the portion of the guide surface which is operatively connected to the air system 12, substantially corresponds to the format of the sheets which are to be processed. The movement of the seal members is preferably performed by a motor actuated from a control desk. Thus, it will be appreciated that the format sizes can be entered manually into the control desk, stored, and later called up by the operator as appropriate, and/or called up based on signals from sensors provided in the printing machine.

It will be appreciated, that one preferred method of operation is as follows. If the format of the sheets 15 to be is smaller relative to the maximum format of the offset printing machine, then selective ones of the seal members 13 which extend in the conveying direction 8 inside the flow duct are loaded or filled with a fluid medium, for example compressed air. This can be completed manually for each individual sheet guiding device 7 from one of the sides of the frame of the printing machine or all of the sheet guiding devices 7 can be adjusted automatically from the control desk when the format of the sheets is entered. When the appropriate seals members 13 are loaded or filled 13 they expand and seal off the portions of the flow ducts 16 of the various sheet guiding devices which are not needed for the particular sheet format being processed. The portions of the flow ducts 16 that are not sealed off remain in fluid communication with the air system 12 and, thus represent the portions that are used for guiding that particular sheet format. Depending on the particular print job, e.g. face printing or perfecting, the air systems 12 for the various sheet guiding devices 7 are operated in either positive pressure mode or negative pressure mode. If the format of the sheets to be processed corresponds approximately to the maximum format of the offset printing machine, then the hollow seals 13 are simply emptied of the respective fluid medium in order to open up the entire flow duct to the air system 13.

From the foregoing it can be seen that the sealing off of the flow ducts 16 through the selective loading or filling of the seal members 13, prevents excess air from being either drawn or blown through the openings 9 in the sheet guide surface 10 when the format of the sheets to be processed is less than the maximum which can be handled by the printing machine. Thus, air flow disturbances are substantially reduced and sheet guidance improved.

While this invention has been described with an emphasis upon a preferred embodiment, it will be obvious to those of ordinary skill in the art that variations of the preferred embodiment may be used and that it is intended that the invention may be practiced otherwise than as specifically described herein. Accordingly, this invention includes all modifications encompassed within the spirit and the scope of the invention as defined by the following claims.

What is claimed is:

1. A device for guiding a sheet as it is conveyed through a deliverer or between printing units of a sheet-fed printing machine, the sheet guiding device comprising:

a guide surface having a plurality of openings therein, at least one flow duct in fluid communication with the openings in the guide surface, an air system in fluid communication with the flow duct, and at least one flexible hollow seal member arranged within the flow duct, the seal member being adapted such that it can be selectively filled with a fluid medium so as to expand the seal member into a sealing position wherein the seal member seals off a predetermined portion of the openings in the guide surface from the air system.

2. The sheet guiding device as in claim 1 wherein in the sealing position the seal member engages a lower side of the guide surface and the housing such that a predetermined portion of the openings in the guide surface are sealed off from the air system.

3. The sheet guiding device as in claim 1 wherein in the sealing position the seal member engages at least one of the openings in the guide surface and the housing such that a predetermined portion of the openings in the guide surface are sealed off from the air system.

4. The sheet guiding device as in claim 1 wherein the fluid medium is a liquid.

5. The sheet guiding device as in claim 1 wherein the fluid medium is a gas.

6. The sheet guiding device as in claim 5 wherein the fluid medium is compressed air.

7. The sheet guiding device as in claim 1 wherein the sheet is conveyed in a conveying direction and the seal member extends in the conveying direction in the flow duct.

8. The sheet guiding device as in claim 1 wherein the sheet is conveyed in a conveying direction and the seal member extends transversely to the conveying direction in the flow duct.

9. The sheet guiding device as in claim 1 wherein the sheet is conveyed in a conveying direction and a plurality of seal members are arranged in the flow duct some extending in the conveying direction and some extending transversely to the conveying direction with the seal members which cross arranged in a butt-to-butt mounting relation.

10. The sheet guiding device as in claim 1 wherein the seal member is movably mounted in the flow duct such that when the seal member is empty the position of the seal member in the flow duct can be selectively adjusted.

* * * * *